US006201526B1

(12) United States Patent
Burgan

(10) Patent No.: US 6,201,526 B1
(45) Date of Patent: Mar. 13, 2001

(54) VISUAL DISPLAY DEVICE

(75) Inventor: John M. Burgan, North Palm Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 08/708,438

(22) Filed: Sep. 4, 1996

(51) Int. Cl.[7] ..... G09G 5/34

(52) U.S. Cl. ..... 345/124; 340/825.44

(58) Field of Search ..... 345/123, 124, 345/125; 340/825.44

(56) References Cited

U.S. PATENT DOCUMENTS

| | | | |
|---|---|---|---|
| 3,938,139 | 2/1976 | Day | 340/324 |
| 3,976,995 | 8/1976 | Sebestyen | 340/337 |
| 4,660,032 | 4/1987 | Tsunoda | 340/825.44 |
| 4,952,927 | 8/1990 | DeLuca et al. | 340/825.44 |

OTHER PUBLICATIONS

Lopatukhin, Coonley and Romero, User Adjustable Message Scroll Speed, Motorola, Inc., Technical Developments, vol. 22, Jun. 1994, pp. 127, 128.

*Primary Examiner*—Matthew Luu

(57) ABSTRACT

A visual display device (10) coupled to a processor (22), a memory (16, 18) and a counter (14) produces procession of displayed alphanumeric characters until a consecutive sequence of at least four numeric or punctuation characters is displayed, at which time the procession stops prior to any character of the at least four consecutive numeric or punctuation characters processes off a viewable portion of a visual display (12). The procession remains stopped until a user of the visual display device intervenes to cause resumption of procession. The visual display device gradually slows the rate of procession when words of at least five consecutive alphanumeric characters are displayed, and gradually increases the rate of procession when words of at least five consecutive alphanumeric characters are no longer displayed. A selective call receiver (11) includes a receiver (23) and the visual display device (10) to display received wireless messages.

2 Claims, 7 Drawing Sheets

11

START
30
MOVE NEXT CHARACTER ONTO DISPLAY
32
ARE THE LAST N OR MORE CHARACTERS DISPLAYED NUMBERS OR PUNCTUATION ?
NO
YES
34
IS THE NEXT CHARACTER TO BE PUT ON THE DISPLAY NOT NUMERIC ?
NO
YES
36
PAUSE PROCESSION
38
USER HALT INPUT ?
YES
NO
40
PAUSE TIME-OUT EXPIRED ?
YES
NO
44
USER CONTINUE INPUT?
NO
YES
46
CONTINUE PROCESSION
37
MORE TO DISPLAY ?
YES
NO
STOP

VISUAL DISPLAY DEVICE

FIELD OF THE INVENTION

This application relates in general to visual displays on portable communication devices and more specifically to controlling the procession of alphanumeric characters on a visual display device.

BACKGROUND OF THE INVENTION

Portable communication devices, such as selective call receivers, have relatively small visual displays in order to maintain the diminutive size of the portable device. Typically, selective call receivers are capable of receiving messages containing many more alphanumeric characters than the maximum number of alphanumeric characters that can be simultaneously displayed on a display device. As a result, only a portion of long messages can be displayed at one time, and the long message must process, or be scrolled, across the display, such as, for example, from right-to-left. The procession of textual material across a relatively small display device produces several disadvantages, one of which is that portions of the text disappear from view after having been displayed for a very short time; furthermore, such portions could contain the most important part of the message, such as the part having a telephone number or the part having a long, uncommon word, such as a person's surname. While a typical user can recognize a telephone number or a long surname as being what they are, a typical user cannot easily memorize the telephone number or the exact spelling of a person's surname. Prior art selective call receivers have provisions for retrieving from memory those portions of a message that are no longer being displayed; however, such known provisions require a user to first depress buttons or otherwise enter commands, and then disadvantageously require the user to manually scroll through the message until the desired important portion appears on the display device. Known portable communication devices also lack provision for automatically stopping the procession of messages when telephone numbers are being displayed.

Attempts have been made to make it possible to manually stop the procession of characters on the display device by inclusion of a freeze switch which, upon depression by a user, would stop the procession. An example of such a feature is shown in U.S. Pat. No. 3,976,995 entitled *Precessing Display Pager*, issued Aug. 24, 1976 to Sebestyen. However, such provision disadvantageously requires the user to depress the freeze button while the important portion of the message, such as a telephone number, is still viewable on the display. As a result, it is necessary that the user react quickly and/or the rate of procession be kept slow which can be annoying because most users are capable of reading words at a faster rate of procession. Another known method of displaying characters entails the automatic pausing of the procession of words, (i.e., groups of alphanumeric characters separated by the space character), when the word reaches the left edge or another preselected position on the display device. An example of a paging receiver with such feature is described in U.S. Pat. No. 4,660,032 entitled *Radio Paging Receiver Operable on a Word-Scrolling Basis*, issued Apr. 21, 1987 to Tsunoda. However, the radio paging receiver of Tsunoda disadvantageously pauses on all words, however long or short, and on all numeric sequences, however long or short.

More recently, a paging receiver that recognizes the difference between an alphabetic character and a numeric character within a message and that displays numeric characters a longer period of time than the period it displays alphabetic characters has been developed. An example of such a paging receiver is disclosed in U.S. Pat. No. 4,952,957 entitled *Paging Receiver with Dynamically Allocated Display Rate*, issued Aug. 28, 1990 to DeLuca, et al., and assigned to the assignee of the present invention. The paging receiver disclosed in DeLuca provides satisfactory performance under most, but not necessarily all operating circumstances. For example, such a paging receiver unnecessarily slows the procession of all numeric characters, including single characters and short numeric "words" that can easily be memorized, because DeLuca lacks provision for distinguishing long numeric words from short numeric words.

Known portable communication devices also lack provision for procession at a fast rate when short words are being displayed, and then smoothly slowing the procession rate when long words are being displayed. Attempts have been made to make it possible to slow the procession of characters on the display device in response to the length of words. For example, U.S. Pat. No. 3,938,139 entitled *Miniature Display Communicator*, issued Feb. 10, 1976 to Day automatically increases the time period of the viewing cycle of each word transferred to the display in proportion to word length. In the miniature display communicator of Day, although there is a procession of words, words are illuminated only while the words are stopped, and the term "viewing cycle" means the time period that a stationary word on the display is illuminated. In Day, the rate of procession does not change with word length; indeed, the rate of procession is not discernible because words are not illuminated during procession. Also known are alphanumeric products having means for a user to preselect the message procession speed; however, the procession speed in such products disadvantageously remains non-responsive to the content of a message.

Thus, what is necessary is an improved display device for use in a selective call receiver that recognizes telephone numbers and long words, and which automatically, selectively displays the telephone numbers and long words in manners that overcomes the deficiencies of the prior art.

DESCRIPTION OF THE PREFERRED EMBODIMENT

Figure 1:
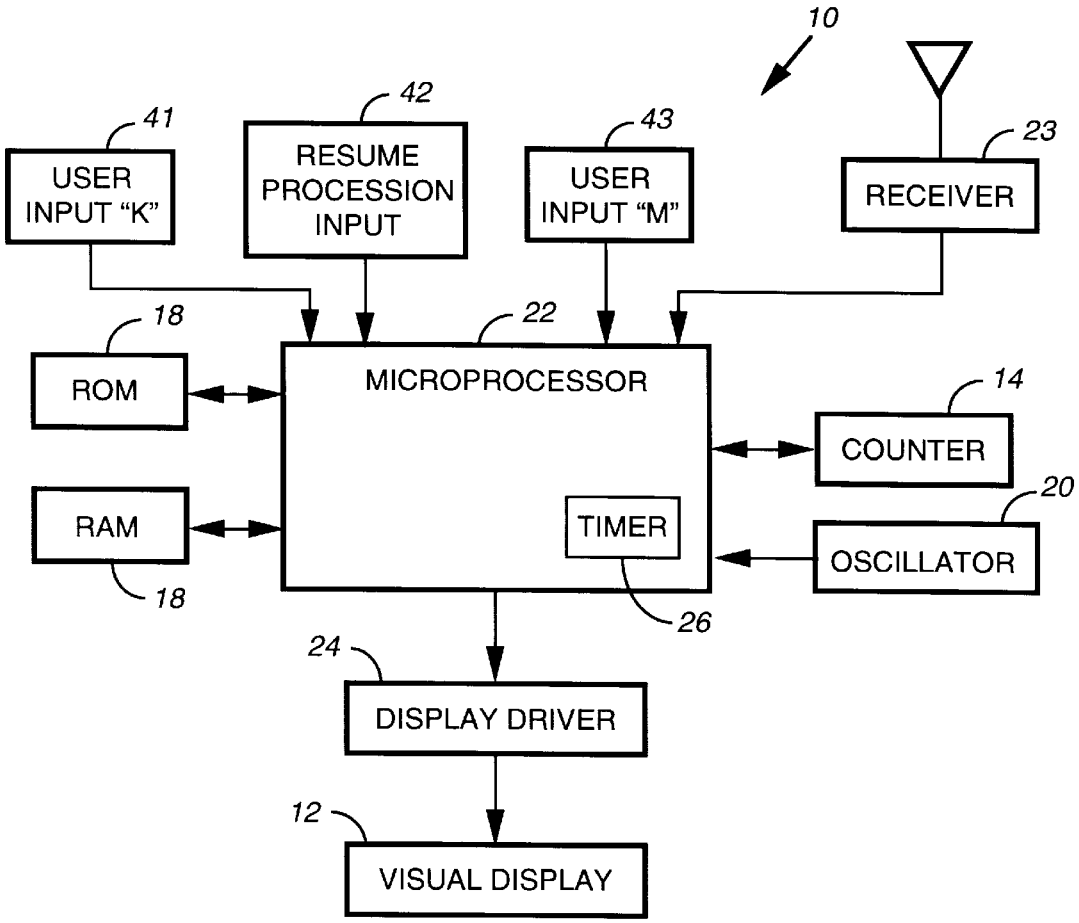
FIG. 1 is a simplified electrical block diagram of a visual display device in accordance with the preferred embodiment of the present invention.

FIG. 1 shows a visual display device 10 comprising a visual display 12, a counter 14, a random access memory (RAM) 16, a read-only memory (ROM) 18, and an oscillator 20 electronically coupled to a processor 22. The visual display 12 is for displaying alphanumeric characters, each alphanumeric character preferably being comprised of a predetermined selection of elements among a matrix of elements having C columns and R rows. The visual display preferably comprises W columns of elements, where W is greater than C, and at least R rows. The visual display 12 is preferably comprised of liquid crystal display (LCD) elements, but alternatively is comprised of light emitting diode (LED) elements. Such a visual display is well known to those skilled in the art, and therefore the details of which are not described herein. The visual display is preferably a single line display capable of displaying approximately twelve to twenty alphanumeric characters for use on a handheld portable communication device such as a selective call receiver. The number of characters displayable on a viewable portion of the visual display depends upon the width of the characters displayed. Alternatively, the visual display is comprised of a set of seven segment elements for each of the twelve to twenty characters. Alternatively, the visual display is a multi-line display.

A selective call receiver 11 in accordance with the preferred embodiment of the invention comprises a receiver 23 coupled to the visual display device 10. In a selective call receiver, for example, the display is used as an output device for showing messages received wirelessly. Such messages are decoded by portions of the receiver (not shown) that are well known to those skilled in the art, and are stored in RAM 16 until displayed on the visual display 12.

As is well known in the prior art, messages of length greater than the maximum number of characters that are displayable on the viewable portion of the visual display automatically process, i.e., scroll, from one edge of the visual display to another edge of the visual display until the entire message has appeared on the visual display. The processor controls the output of the visual display, including procession of the message on the visual display, through a display driver 24. A timer 26 generates the timing signals utilized in the operation of the processor. The oscillator 20 is, for example, a crystal oscillator, and is coupled to the inputs of the timer to provide a reference signal for establishing the processor timing. The RAM is utilized to store variables derived during processing, as well as to provide storage of message information that are received during operation as the selective call receiver. A software element which stores the subroutines that control the operation of the visual display device resides in the ROM 18. The processor is preferably a microprocessor such as a Motorola M68HC11PH8, that performs the instructions set forth in software to control the operation of the visual display in accordance with the invention. A person skilled in the art of programming prepares the software using a *Motorola HC*11 *Reference Manual*, published 1991 by Motorola, Inc., and using a *Motorola MC*68*HC*11*PH*8 *Technical Data*, published 1995 by Motorola, Inc., Part No. M68HC11RM/AD and Part No. MC68HC11PH8/D, respectively, which are available for sale to the public from Motorola Literature Distribution, Phoenix, Ariz.

The procession of alphanumeric characters, preferably from a right edge of the display device to a left edge of the display device, is controlled by the processor. However, unlike prior art display devices, the procession of messages on the visual display in accordance with the invention is responsive to the content of the displayed alphanumeric characters. For example, although a message composed entirely of short words and short numeric sequences will process (i.e., move from right to left) conventionally, messages containing long numeric sequences, such as a telephone number will cause the processor 22 to a pause or stop the procession of the message. Telephone numbers are usually comprised of sequences of seven or ten digits. Interspersed within such sequence is sometimes one or two punctuation characters such as a hyphen, a set of parenthesis, and the space character. Because a telephone number is often the most important part of a wireless message received by the selective call receiver 11, and because a telephone number must be perceived exactly, it is advantageous to either pause or stop the procession of the message after the telephone number appears on the display device, but before it processes off the display device. The processor of the visual display device in accordance with the invention utilizes software stored in ROM to recognize multi-digit numeric sequences within messages and pauses, or alternatively stops, the procession of the message.

Figure 2:
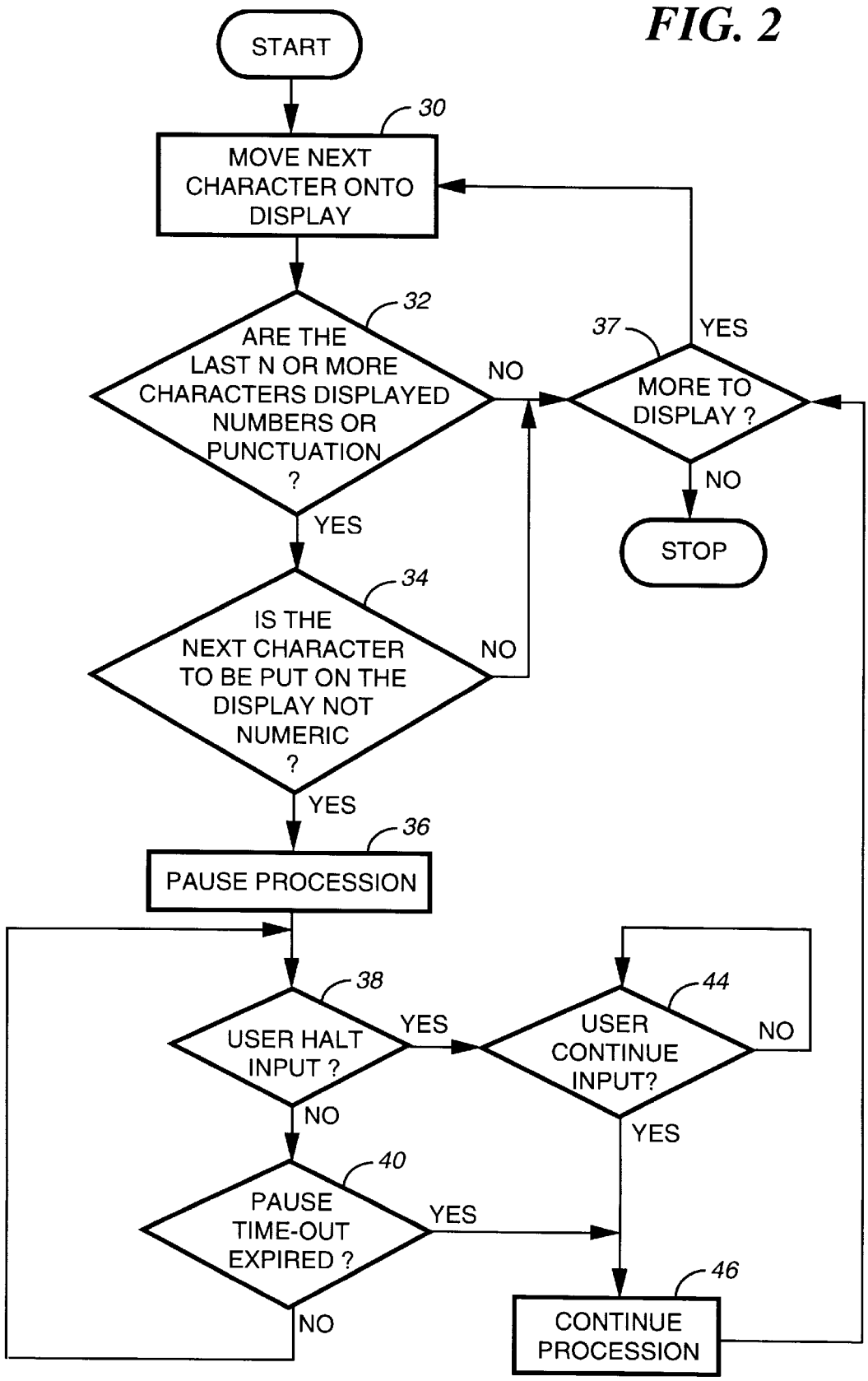
FIG. 2 is a flow diagram of steps executed by a processor of the visual display device to control pausing of procession when a sequence of numeric characters is displayed.

Referring now to FIG. 2 which is a flow diagram illustrating an operation executed by the processor 22 through the use of software to control the visual display device of FIG. 1 in accordance with the invention. Each character of a message is sequentially moved onto the visual display 12 from storage in RAM, step 30. Each alphanumeric character is categorized as being a member of the group of numeric characters, i.e., the ten digits, or a member of the group of punctuation characters, including the space character, that usually are interspersed within telephone numbers, or a member of the group of alphabetic characters. Non-printable characters and control characters are categorized together in a fourth group. At step 32, a decision is made whether the most recently displayed n characters are numeric or punctuation, if they are neither numeric nor punctuation, then at step 37 a decision is made whether there are more characters to be displayed, if there are more characters to be displayed, then at step 30 the next character is moved onto the display preferably, n=7. It should be pointed out that n=7 is only one example of a design choice for the number of most recently displayed characters. At step 32, if the last seven characters displayed are all numeric or punctuation, then the procession of the characters on the display will pause (step 36), unless a determination is made that the next character to be displayed is also numeric (step 34). If the next character to be displayed is not also numeric, the next character is moved onto the display (step 30). If a determination is made at step 34 that the next character to be displayed is also numeric, the procession continues at step 30 until a non-numeric character is displayed, at which time the procession pauses (step 36). The procession pauses for a preselected period of time, to allow the user to write down or remember the telephone number, and then, when the Pause Time-Out expires (step 40), the procession continues (step 46) if there are more characters to be displayed (step 37). If the user activates at step 38 a Resume Procession Input element 42 (see FIG. 1), such as a button (not shown) on a selective call receiver, prior to the preselected period expiring, the procession will stop indefinitely, and the procession will resume only if the user activates again at step 44 the Resume Procession Input element 42.

Figure 3:
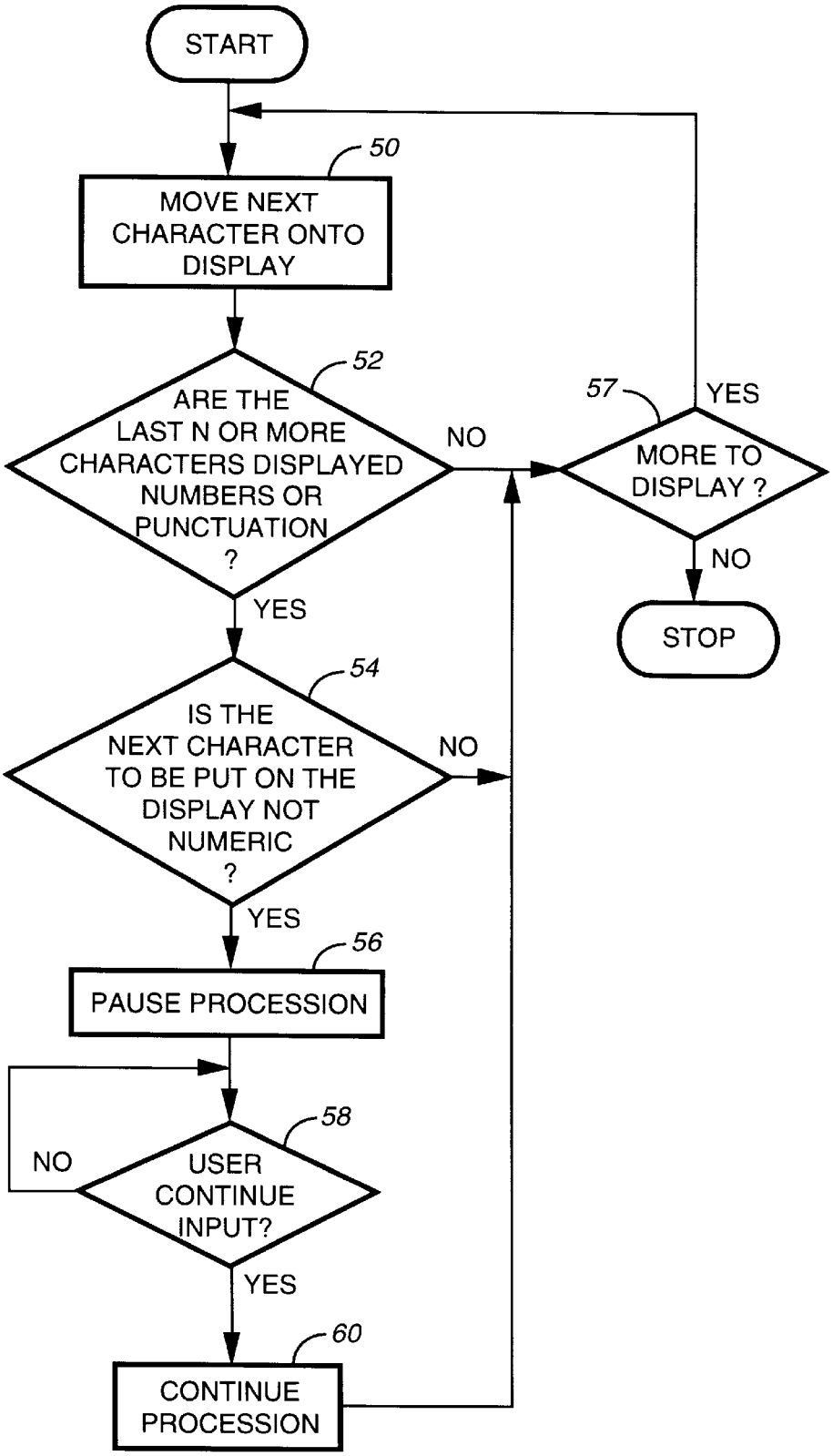
FIG. 3 is a flow diagram of steps executed by the processor to control stopping of procession when a sequence of numeric characters is displayed.

Referring now to FIG. 3, there is shown an alternative operation after the procession pauses at step 56. It should be noted that steps 50, 52, 54, 56 and 58 of FIG. 3 are substantially similar to the corresponding steps 30, 32, 34, 36 and 37, respectively of FIG. 2. Once the procession pauses (step 56), it will not resume until at step 58 the user activates the Resume Procession Input element 42 (see FIG. 1), at which time the procession resumes (step 60).

Figure 4:
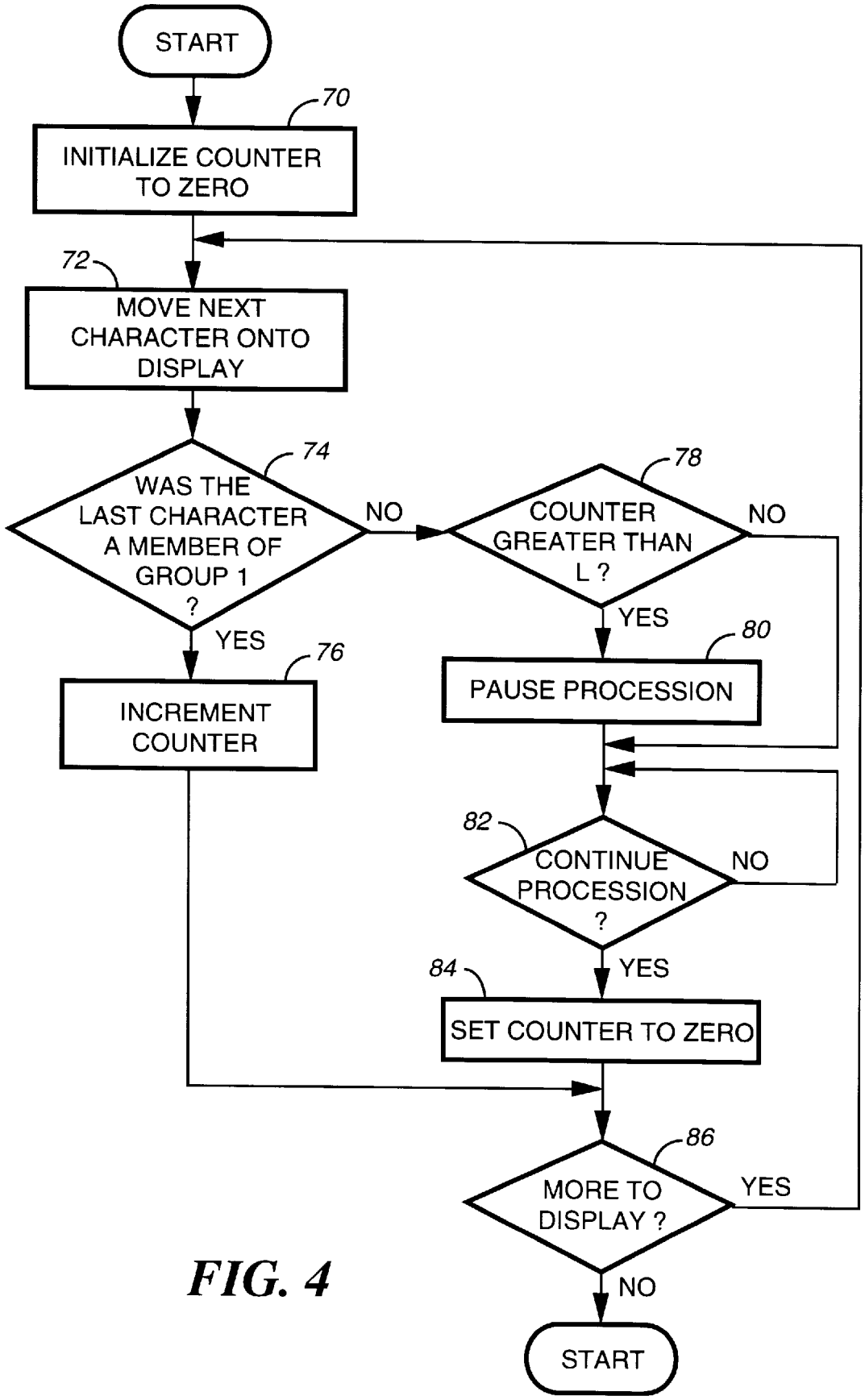
FIG. 4 is a flow diagram executed by the processor to recognize a sequence of numeric characters of preselected length.

Referring now to FIG. 4, a flow diagram is shown that shows the steps executed by the processor to recognize a sequence of numeric characters longer than of a preselected length. Preferably, the preselected length is six because seven is the minimum length of most telephone numbers, although it should be appreciated that some telephone numbers are of other lengths. At step 70, the counter 14 is set to zero. At step 72, the next character is moved onto the display. At step 74, a decision is made whether the last character moved onto the display is a member of Group One, Group One comprising the numeric characters and punctuation characters that are often interspersed between the digits of a telephone number. If the last character was a member of Group One, then at step 76, the counter is incremented by 1, and the operation proceeds to step 86 (explained below). If the last character was not a member of Group One, then, at step 78, a determination is made whether the setting of the counter is greater than L. If the setting of the counter is greater than L, then at step 80, the procession pauses. Next, a determination is made at step 82 whether the procession should resume, based upon an input by a user such as through the Resume Procession Input element 42. On the other hand, if the determination is made at step 78 that the setting of the counter is not greater than L, step 80 is skipped, and step 82 is executed. If no user input occurs, then the operation remains at step 82 waiting for a user input to occur. Once a user input occurs, the counter is set to zero at step 84. It should be noted that step 82 of FIG. 4 is substantially equivalent to step 58 of FIG. 3. Alternatively, step 82 of FIG. 4 is substantially equivalent to the series of steps 38, 40, and 44 of FIG. 2, in which case an expiration of the pause timer, step 40, produces an effect equivalent to an input from a user. After the user input occurs, a determination is made at step 86 whether there are additional characters of the message to be displayed. If there are additional messages to be displayed, the operation proceeds to step 72. If there are no additional characters of the message to be displayed, the operation stops.

Figure 5:
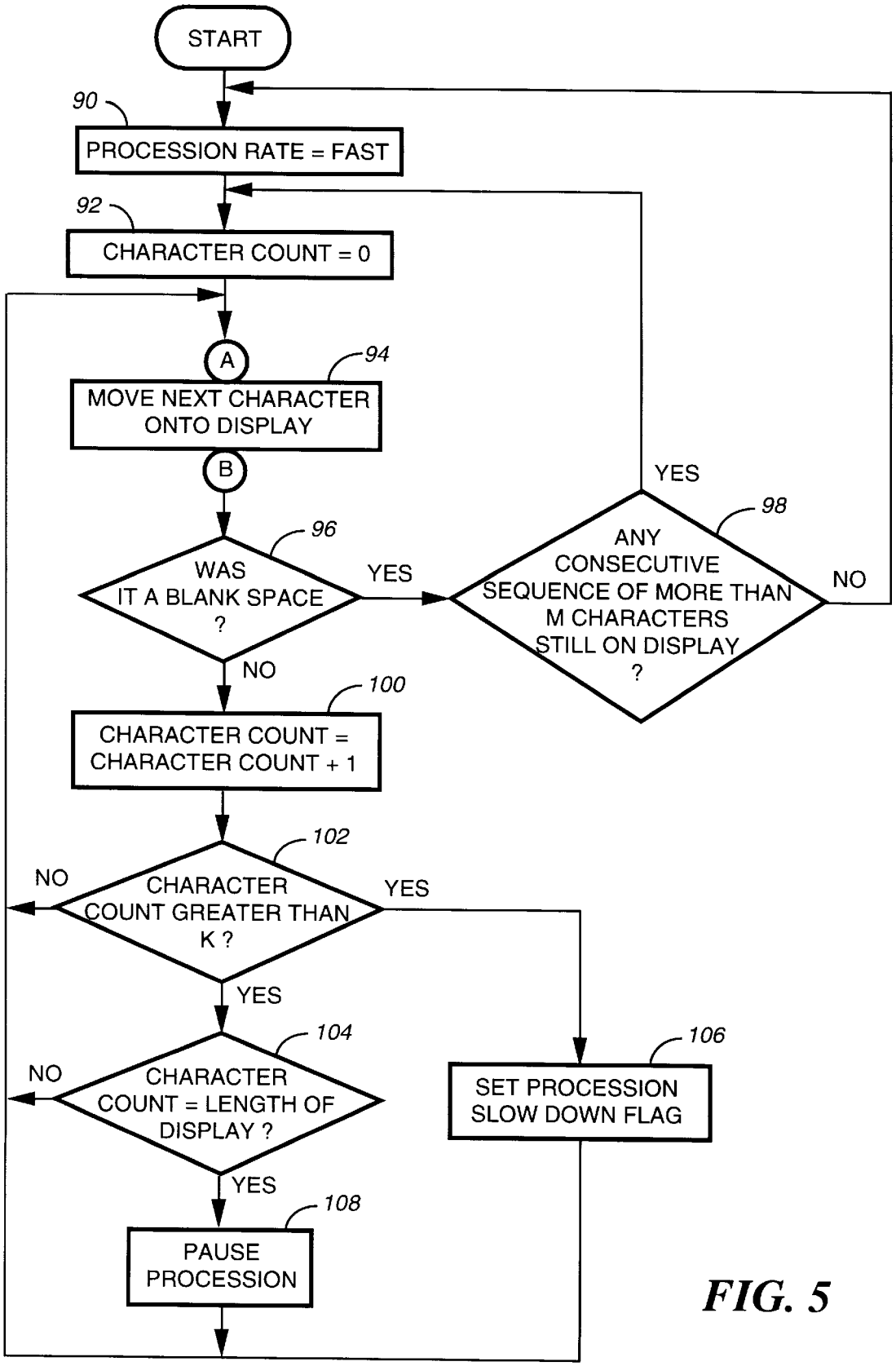
FIG. 5 is a flow diagram of steps executed on the processor to control the rate of procession in response to length of words.

Referring now to FIG. 5, which is a flow diagram of steps executed by the processor to control the rate of procession in response to the length of a word, i.e., the number of letters in a word, displayed on the visual display device in accordance with the invention. It should be pointed out that the processor 22 alternatively concurrently performs the steps set forth in FIG. 5 in addition to the steps set forth in one of FIG. 2 or FIG. 3. A visual display device in accordance with the invention has a predetermined fast rate and a predetermined slow rate stored in ROM. Initially the rate of procession is fast, step 90. This fast rate of procession is an advantage of the invention because a typical user is able to perceive and comprehend short words more easily than long words. Prior art visual display devices have their rate of procession set at a rate that is annoyingly slow for short words so that less frequently occurring long words can be easily read. The invention advantageously allows a visual display device to slow the rate of procession of the visual display when long words are being displayed. By the term "word" it is meant a consecutive sequence of alphabetic characters without any other intervening characters such as the space character. It is foreseen that the slow procession rate in accordance with the invention is only slightly slower than the fixed procession rate of prior art visual display devices, while the fast procession rate is substantially faster than the fixed procession rate of prior art visual display devices, and, as a result, the overall time of presentation of a typical message is advantageously shorter. Next, a character counter is set to zero (step 92). Then, a character is moved onto the display (step 94). A decision is made at step 96 whether the character is the space character. If the character is the space character, a decision is made at step 98 whether any consecutive sequence of more than m characters is still on the display. The value of m is selectable by the user through a User Input "M" element 43 (see FIG. 1). Preferably, m=5. Alternatively not shown, a determination is made at step 98 whether any portion of a word, the word having more than k characters, is still on the display. If there is such a portion still on the display, the counter is re-set to zero at step 92 and the operation continues from step 92, with the procession rate being slow. The value of K is selectable by the user through a User Input "K" element 41 (see FIG. 1). Preferably, K=7. If there is no portion of a word having more than k characters on the display, then the procession rate is re-set to fast at step 90 and the operation continues from step 90, with the procession rate being fast. Returning now to the preferred embodiment shown in FIG. 5, if a determination is made at step 96 that the character was not the space character, the setting of the character counter is incremented by one (step 100). If the setting of the character count is not greater than k (step 102), the operation returns to step 94 where the next character is moved onto the display. The value of k is selectable by the user through a User Input "K" element 41 (see FIG. 1). Preferably, k=7. If the character count is greater than seven (step 102), a Procession Slow Down flag is set (step 106), and the operation returns to step 94 where the next character is moved onto the display. In addition, if the character count is greater than seven, a check is made at step 104 whether the character count is equal to the maximum number of characters that can be shown on the display. If the character count is so equal, then the procession of characters on the display is paused (step 108). If the character count is less than the maximum number of characters that can be shown on the display, then the operation returns to step 94.

In summary, FIG. 5 describes an operation that immediately changes the procession rate from fast to slow when the eighth character of a word appears on the display, and retains the fast rate while any character of any word of eight characters or more remains on the display, and then immediately reverts to the slow rate. Alternatively, when the first few characters of a word beyond the seventh character (e.g., the 8th, 9th, and 10th character) appear on the display, the procession rate is at one or more intermediate procession rates, intermediate the fast rate and the slow rate, and only when the next character (the 11th in this example) appear on the display does the procession rate change to slow. Analogously, the procession rate can be gradually increased in intermediate steps.

Figure 6:
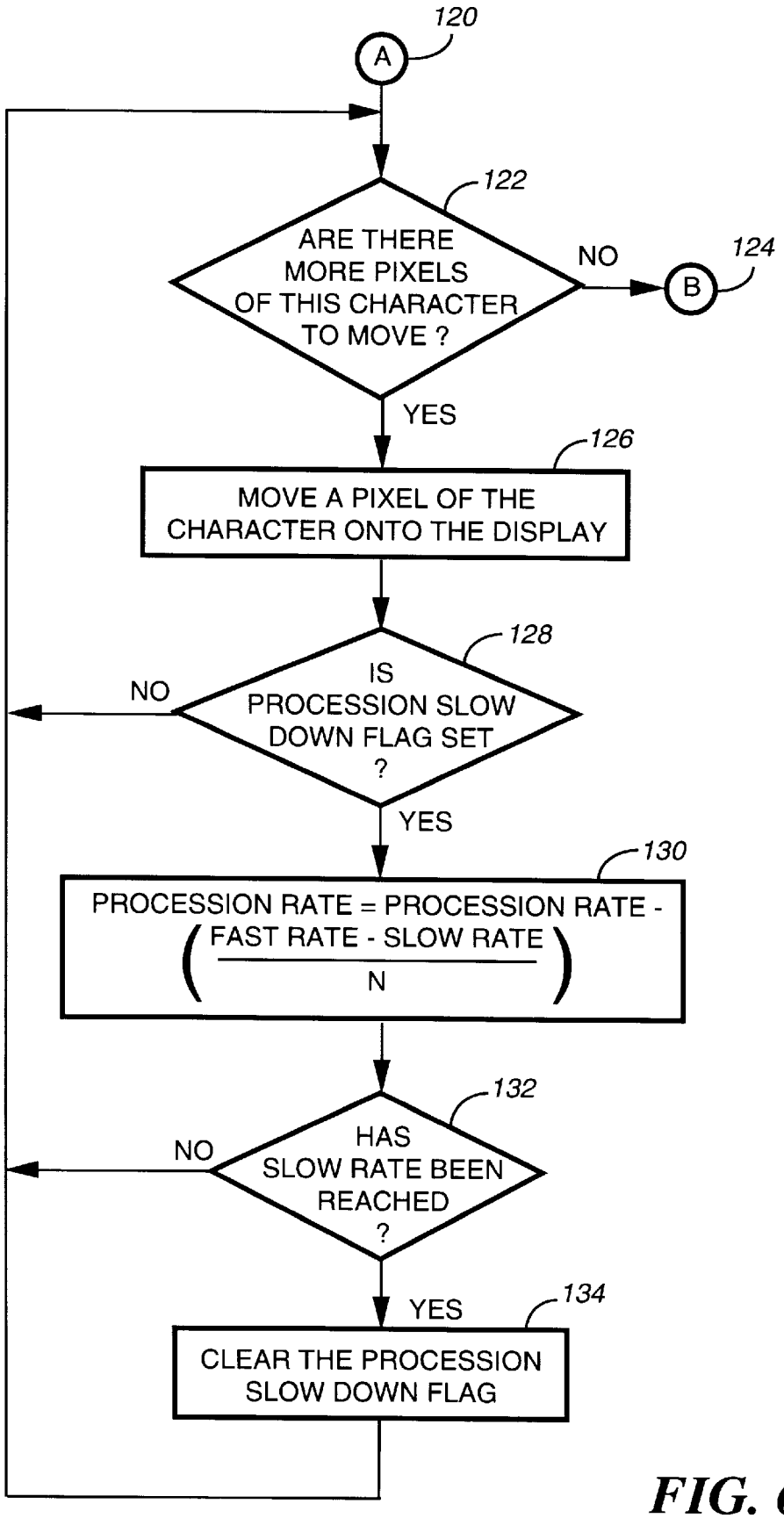
FIG. 6 is a flow diagram of steps executed on the processor to control the gradual change of rate of procession.

FIG. 6 is a flow diagram showing a set of steps that is alternatively substituted for step 94 of FIG. 5 when the display is comprised of a matrix of elements, such as pixels, and where each character is formed by activating a predetermined selection of such elements among a matrix of elements having C columns and R rows. In the alternative embodiment of FIG. 6, rather than the processor performing the step 94 of FIG. 5, the processor checks whether there are any additional pixels of a character to be moved onto the display, step 122. If there are not any more pixels, then the procedure returns to step 96 of FIG. 5. If there are more pixels, an additional column of pixels of that character is moved onto the display and, of course, all characters on the display move, in procession, one pixel. Next, at step 128, a check is made whether the Procession Slow Down flag is set. If the Procession Slow Down flag is not set, the operation returns to step 122 and the next column of pixels is moved at the fast rate. If the Procession Slow Down flag is set, the procession rate is reduced from the fast rate to the slow rate in N intermediate steps, each step reducing the rate by an equal amount, the equal amount being calculated as follows: (fast rate−slow rate) /N, where N is at least 2. The value of N is a design choice, but by having N be at least 2, there will be produced at least one intermediate procession rate between the fast rate and the slow rate. A visual display device in accordance with the invention has a predetermined value of N stored in ROM. At step 130, the procession rate is reduced. At step 132 a determination is made whether the slow procession rate has been reached. If not, the operation returns to step 122, then, if there are additional pixels of the character to be moved (step 126), the next column of pixels is moved at a slower rate (step 130). If at step 132 a determination is made that the slow procession rate has been reached, the Procession Slow Down flag is cleared (step 134). The alternative operation shown in FIG. 6, is performed each time the step 94 of FIG. 5 is executed; as a result, the procession rate can be reduced from fast to slow over any number of columns of pixels, including a number of columns of pixels extending over several characters. The number of columns of pixels over which the procession rate is reduced is equal to N. Preferably, the number of columns over which the procession rate is reduced is at least equal to or greater than the number of columns C of a character. Although not shown, the procession rate is gradually increased in a manner directly analogous to the operation shown in FIG. 6.

Figure 7:
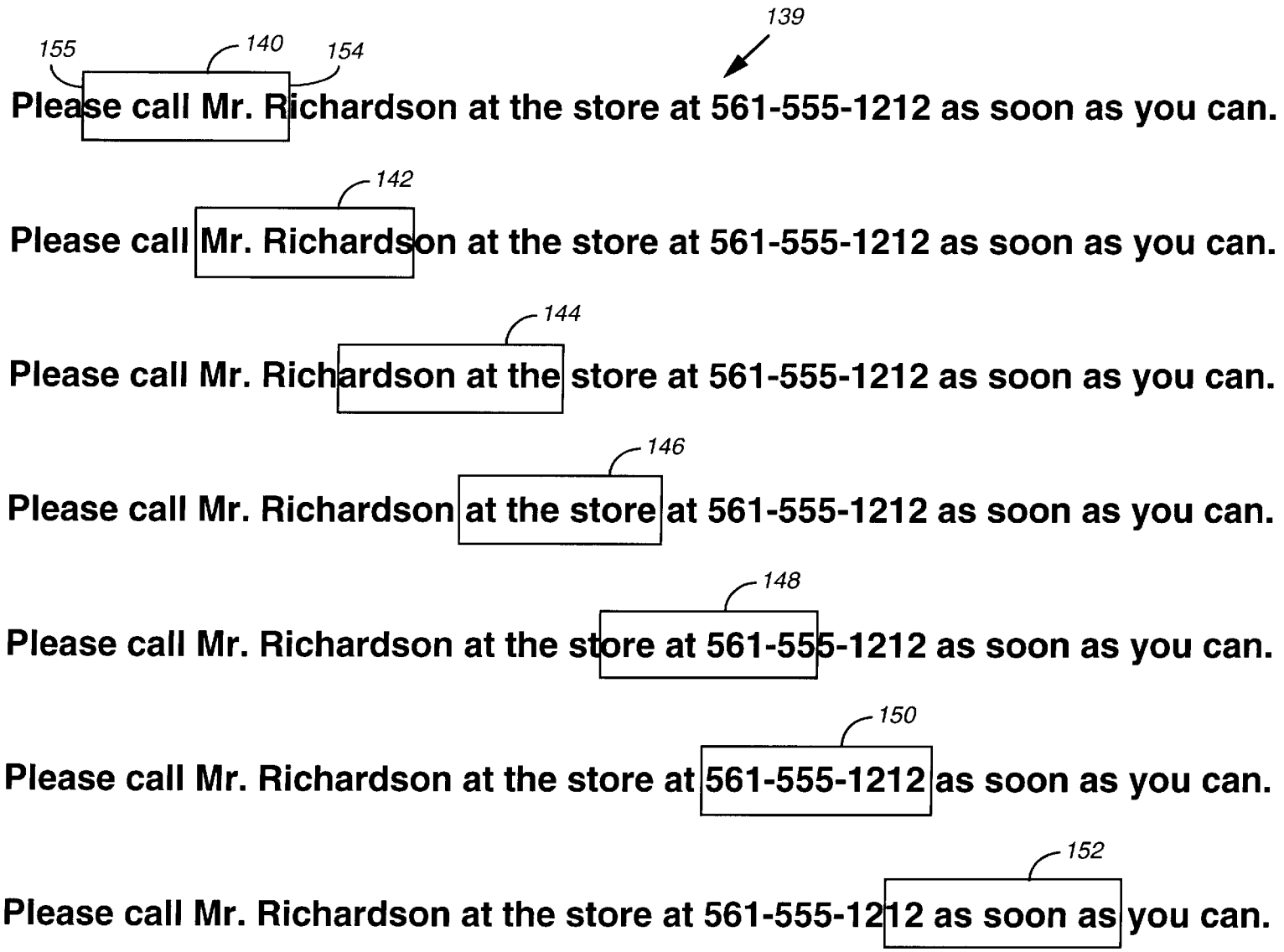
FIG. 7 shows an exemplary message with portions of the message highlighted by a sequence of rectangular boxes representing a viewable portion of a visual display of the visual display device in accordance with the invention.

Referring now to FIG. 7, which shows an exemplary message 139 with portions of the message highlighted by a sequence of rectangular boxes representing a viewable portion of the visual display 12 of the visual display device 10 at different moments in time. In this example, k=7. A visual display device in accordance with the invention displays an exemplary message as follows: When the portion of the message within box 140 is visible, the message is processing at the fast rate of procession. The portion of the message within box 142 shows eight consecutive characters, "RICHARDS". When the portion of the message within box 142 is visible, the message is processing at the slow rate because more than seven consecutive alphabetic characters are visible (see step 102 shown in FIG. 5). The portion of the message in box 144 shows six consecutive characters, "ARDSON". When the portion of the message within box 144 is visible, the message continues to move at the slow rate if to m=5 had been the design choice selected. However, if, instead, m=6 had been the design choice selected, then, when the portion of the message within box 144 is visible, the message is processing at the fast rate of procession because there are not more than six consecutive characters visible. In the alternative embodiment (not shown in FIG. 5), when the portion of the message in box 144 is visible, the message is still moving at the slow rate because a portion "ARDSON" of a word having more than k=7 consecutive characters "RICHARDSON" is still visible.

Referring again to FIG. 7, when the portion of the message within box 146 is visible, the message moves at the fast rate because neither a telephone number nor a long word is visible. The portion of the message visible within box 148 shows a consecutive sequence of six telephone number characters "561-55". The dash character is a member of the group of punctuation marks that is often inserted between telephone number numerals; and therefore, the dash character is counted as a telephone number character. When the portion of the message within box 148 is visible, the message continues to move at the fast rate because there is not (yet) visible a consecutive sequence of more than six telephone number characters (see step 32 shown in FIG. 2 or step 52 shown in FIG. 3, and assume n=7 had been the design choice selected). When the characters "561-555" are visible on the visual display (not shown), execution of step 32 of FIG. 2 results in a decision of "YES" because the last seven or more characters displayed are numbers or punctuation. When the portion of the message within box 150 is visible, the procession pauses. The explanation depends upon which alternative embodiment is implemented: the procession pauses because telephone number character t7, which in this example is the last or right-most "5", reaches one edge 154 of the viewable portion of the visual display; the procession pauses because telephone number character $t_1$, which in this example is the first or left-most "5", reaches another edge 155 of the viewable portion of the visual display; or the procession pauses because the next character to be put on the display is not numeric (see step 34 shown in FIG. 2). The procession remains paused until, for example, the Pause Time-Out has expired, at which time the procession continues. When the portion of the message within box 152 is visible, the message is moving at the fast rate of procession. In the foregoing example, each of the characters of the telephone number "561-555-1212" is permanently assigned an associated number by the processor. The associated number is a then current setting of the counter 14. By the word "permanent" is meant that the associated number assigned to a telephone number character does not change as the current setting of the counter changes. Each telephone number character and its associated number is temporarily stored in RAM at least until the character has processed across the viewable portion of the visual display. The viewable portion of the visual display 12 is that portion between the one edge 154 and the another edge 155. In this example the associated numbers are 1, 2, 3, 4, 5, 6, 7, 8, 9, 10, 11 and 12, respectively.

Therefore, what has been described is a visual display device 10 for displaying alphanumeric characters that includes a visual display 12, and a processor 22 coupled to the visual display for controlling procession of displayed alphanumeric characters across the visual display. The processor 22 is programmed to execute the steps of: moving the displayed alphanumeric characters from the one edge 154 of the visual display 12 to the another edge 155 of the visual display; determining a consecutive sequence of at least n telephone number characters, $t_1, t_2, t_3 \ldots t_n$, for display on the visual display, each of the telephone number characters being from a group comprising numeric characters; and stopping the procession of the displayed alphanumeric characters while the telephone number characters $t_1, t_2, t_3 \ldots t_n$ are displayed on the visual display. The procession of the displayed alphanumeric characters stops when telephone number character $t_1$ is at the another edge of the visual display, or alternatively, stops when telephone number character tn is at the one edge of the visual display. The visual display device also includes a user input element, such as the Resume Procession Input element 42, coupled to the processor 22 for activating resumption of procession the displayed alphanumeric characters. The visual display device 10 includes a counter 14 and a memory 16 and 18 for storage of the alphanumeric characters prior to display on the visual display 12. The step of determining includes setting the counter to 0, and comparing sequentially each alphanumeric character in the memory with a group consisting of numeric characters and punctuation characters and with another group consisting of alphabetic characters. The step of determining also includes the steps of: in response to the step of comparing, incrementing the counter by 1 when an alphanumeric character in the memory is from the group consisting of numeric characters or punctuation characters, to create a current setting of the counter; and permanently assigning an associated number to each alphanumeric character in the memory that is a numeric or punctuation character, the associated number being a then current setting of the counter. The step of determining further includes the step of: in response to the step of comparing, re-setting the counter to 0 when an alphanumeric character in the memory is an alphabetic character.

It should also be clear that a visual display device 10 for displaying alphanumeric characters has been described which includes a visual display 12 comprised of a matrix of W columns of elements and at least R rows of elements, and where each alphanumeric character is produced by the display driver 24 activating a predetermined selection of elements from a matrix of elements having C columns and R rows. The visual display device 10 also includes a processor 22 electronically coupled to the visual display 12 for controlling procession of the alphanumeric characters across the visual display at a rate of columns per unit time. The rate of procession is capable of being one of the following rates: a fast rate, a slow rate, and one of a plurality of intermediate rates between the fast rate and the slow rate. The processor is programmed to execute the steps of: procession of the alphanumeric characters from a right edge of the visual display to a left edge of the visual display at the fast rate; determining a consecutive sequence of more than k alphanumeric characters, $t_1$, $t_2$, $t_3$ . . . $t_k$ without an intervening space alphanumeric character being displayed on the visual display; changing procession the alphanumeric characters from the fast rate to the slow rate until no consecutive sequence of more than m alphanumeric characters, $t_1$, $t_2$, $t_3$ . . . $t_m$ without an intervening space alphanumeric character is displayed on the visual display; and resuming procession the alphanumeric characters at the fast rate. The visual display device further includes a user input element coupled to the processor for selecting values of at least one of k and m. The step of changing includes gradually changing procession rate from the fast rate, to at least one of the plurality of intermediate rates, and from the at least one of the plurality of intermediate rates to the slow rate, over a distance of at least C columns.

The term "to process" as used in this patent is a verb meaning to move along in, or as if in, a procession; to move a line of things as if in a procession; to proceed in orderly succession; and to scroll. As applied more specifically to the invention, a phrase such as "a message processes" means that the message is made to travel across the visual display such that the portion of the message that has already been viewed disappears at a left edge of the visual display, while at the right edge of the visual display a new portion of the message appears. A message processes when each of the alphanumeric characters of which the message is composed moves across the viewable portion of the visual display in unison or in tandem.

While a detailed description of the preferred embodiment of the invention has been given, it should be appreciated this invention can be realized in a number of embodiments, of which the disclosed embodiment is only one alternative, without departing from the scope of the invention as set forth in the appended claims. For example, it is foreseen that each telephone number and/or each long word within a message can re-appear on the visual display at the end of the message whence they came. They can re-appear while moving at a fast, or, alternatively, at a slow, procession rate. Another variation is that each number or long word can re-appear without procession until the user depresses a button or until a preselected period of time has elapsed. A further variation is that each telephone number and/or long word re-appears only after the user depresses a button.

What is claimed is:

1. A selective call receiver, comprising:

a receiver for receiving a wireless message;

a visual display for displaying alphanumeric characters of a wireless message, each of the alphanumeric characters comprised of a predetermined selection of elements among a matrix of elements; and a processor coupled to the visual display for controlling procession of the alphanumeric characters across the visual display at a rate of columns per unit time, the rate of procession capable of being one of a fast rate and a slow rate, programmed to execute the steps of:

procession of the alphanumeric characters from one edge of the visual display to another edge of the visual display at the fast rate, determining a consecutive sequence of more than k alphanumeric characters without an intervening space alphanumeric character being displayed on the visual display, procession of the alphanumeric characters from the one edge of the visual display to the other edge of the visual display at the slow rate while the consecutive sequence of more than k alphanumeric characters without an intervening space alphanumeric character is displayed on the visual display, determining an absence of a consecutive sequence of more than m alphanumeric characters where m<k, without an intervening space alphanumeric character being displayed on the visual display, and procession of the alphanumeric characters from the one edge of the visual display to the other edge of the visual display at the fast rate.

2. A visual display device for displaying alphanumeric characters, each of the alphanumeric characters comprised of a predetermined selection of elements among a matrix of elements, comprising:

a visual display; and a processor coupled to the visual display for controlling procession of the alphanumeric characters across the visual display at a rate of columns per unit time, the rate of procession capable of being one of a fast rate and a slow rate, programmed to execute the steps of:

procession of the alphanumeric characters from one edge of the visual display to another edge of the visual display at the fast rate, determining a consecutive sequence of more than k alphanumeric characters without an intervening space alphanumeric character being displayed on the visual display, procession of the alphanumeric characters from the one edge of the visual display to the other edge of the visual display at the slow rate while the consecutive sequence of more than k alphanumeric characters without an intervening space alphanumeric character is displayed on the visual display, determining an absence of a consecutive sequence of more than m alphanumeric characters, where m<k, without an intervening space alphanumeric character being displayed on the visual display, and procession of the alphanumeric characters from the one edge of the visual display to the other edge of the visual display at the fast rate.

* * * * *